United States Patent [19]

Mizuno et al.

[11] 4,454,849

[45] Jun. 19, 1984

[54] CANISTER FOR INTERNAL COMBUSTION ENGINE

[75] Inventors: Junzi Mizuno; Akira Fukami; Kunio Okamoto; Takeshi Ishii, all of Okazaki, Japan

[73] Assignees: Nippon Soken, Inc., Nishio; Nippondenso Co., Ltd., Kariya, both of Japan

[21] Appl. No.: 380,907

[22] Filed: May 21, 1982

[30] Foreign Application Priority Data

May 22, 1981 [JP] Japan ..... 56-78506

[51] Int. Cl.[3] ..... F02M 37/00

[52] U.S. Cl. ..... 123/519; 55/307; 55/464; 55/419; 55/418; 55/387

[58] Field of Search ..... 123/518–521; 55/307, 527, 464, 419, 418, 387

[56] References Cited

U.S. PATENT DOCUMENTS

| | | | |
|---|---|---|---|
| 1,857,512 | 5/1932 | Matteson | 55/527 |
| 3,000,467 | 9/1961 | Bowers | 55/201 |
| 3,479,146 | 11/1969 | Hochman et al. | 55/418 |
| 3,616,617 | 11/1971 | Groote | 55/307 |
| 3,628,517 | 12/1971 | Soberski | 123/519 |
| 3,683,597 | 8/1972 | Beveridge et al. | 123/519 |
| 3,730,158 | 5/1973 | St. Amand | 123/519 |
| 3,884,204 | 5/1975 | Krautwurst et al. | 123/519 |
| 4,058,380 | 11/1977 | King | 123/519 |
| 4,157,902 | 6/1979 | Tokar | 55/418 |
| 4,173,207 | 11/1979 | Hiramatsu | 123/519 |
| 4,203,401 | 5/1980 | Kingsley et al. | 123/519 |
| 4,280,466 | 7/1981 | Walters | 123/520 |
| 4,306,894 | 12/1981 | Fukami et al. | 123/519 |
| 4,308,840 | 1/1982 | Hiramatsu et al. | 123/519 |
| 4,331,120 | 5/1982 | Hiramatu et al. | 123/519 |
| 4,338,106 | 7/1982 | Mizuno et al. | 123/519 |

FOREIGN PATENT DOCUMENTS

| | | | |
|---|---|---|---|
| 211414 | 9/1907 | Fed. Rep. of Germany | 55/307 |
| 53-77923 | 7/1978 | Japan | 123/519 |

*Primary Examiner*—Ira S. Lazarus
*Assistant Examiner*—Magdalen Moy
*Attorney, Agent, or Firm*—Cushman, Darby & Cushman

[57] ABSTRACT

A canister to be used in the fuel supplying system of an internal combustion engine of a vehicle, is disclosed. The canister is provided with a fuel vapors guiding pipe for guiding the fuel vapors from a fuel vapors inlet port into a bed of adsorbent material accomodated within a housing, and a deflector for deflecting the flow of fuel vapors guided by the guiding pipe so as to be dispersed throughout the bed. The deflector is formed of air-permeable material having a flowing resistance slightly larger than that of the bed into a frusto-conical plate. According to the present invention, one part of the fuel vapors flowing into the bed through the guiding pipe in the fuel vapors adsorbing process flows along the upper surface of the deflector in the direction of the upper portion of the bed and another part of the fuel vapors flows through the deflector in the direction of the lower portion of the bed. Fresh air sucked into the bed in the fuel vapors purging process flows through the bed without being obstructed by the deflector so that the fuel vapors adsorbed by the whole bed are purged.

7 Claims, 8 Drawing Figures

CANISTER FOR INTERNAL COMBUSTION ENGINE

BACKGROUND OF THE INVENTION

The present invention relates to a canister to be used in the fuel supplying system of an internal combustion engine of a vehicle.

Generally, the canister is provided with a housing accomodating a bed of an adsorbent material. In an upper end wall of the housing, a fuel vapors inlet port communicated with a fuel source, and a purged vapors outlet port communicated with an intake passage of the internal combustion engine are provided. And in a lower end wall which is opposed to the upper end wall through the bed of adsorbent material, an air suction port communicated with the atmosphere, is provided.

When the internal combustion engine is stopped, the fuel vapors entering the housing from the fuel vapors inlet port, flow into the bed from the upper surface thereof and are adsorbed by the adsorbent material.

When the engine is in operation, negative pressure is generated in the intake passage so that fresh air is sucked into the bed of adsorbent material from the air suction port. Consequently, the fuel vapors which are adsorbed by the adsorbent material, are purged therefrom, and the purged vapors are sucked into the intake passage.

The conventional canister of this type has a problem as follows. Namely, during hot weather periods, fuel vapors are apt to be supplied into the housing in the fuel vapor purging process. The introduced fuel vapors are directly sucked from the housing through the purged vapors outlet port without flowing into the bed of adsorbent material so that air-fuel ratio temporarily decreases so as to lower the engine performance and increase the amount of unburnt components in exhaust gases.

In order to solve the above problem, a fuel vapors guiding pipe of which base end is communicated with the fuel vapors inlet port and which projects into the adsorbent bed has been employed. By providing the fuel vapors guiding pipe, the fuel vapors are guided into the absorbent bed that the fuel vapors can be prevented from bypassing from the fuel vapors inlet port to the purged vapors outlet port without passing through the adsorbent bed.

However, the canister provided with the fuel vapors guiding pipe has such a problem that the fuel vapors cannot reach the upper portion of the adsorbent bed above the projecting end of the guiding pipe, and that the fuel vapors cannot reach the outer peripheral portion of the adsorbent bed since the guiding pipe has a diameter considerably smaller than that of the housing. As a result, the adsorbing efficiency of the adsorbent bed is lowered.

In order to solve the above problem, a frusto-conical deflector has been employed. In this case, the deflector is buried within the adsorbent bed so as to be opposed to the projecting end of the fuel vapors guiding pipe for deflecting the flow of the fuel vapors guided by the fuel vapors guiding pipe in the direction of the upper portion and the outer peripheral portion of the bed.

By providing the deflector in the canister, adsorbing capacity of bed is improved but the flow of the sucked air is obstructed by the deflector so that the amount of unpurged fuel vapors is large.

Accordingly, an object of the present invention is to provide a canister having excellent adsorbing and purging capacity.

Another object of the present invention is to provide a canister having a deflector which guides the fuel vapors flowing into a bed of adsorbent material so as to be dispersed throughout the whole bed and does not obstruct the flow of fresh air sucked into the bed.

DESCRIPTION OF THE DRAWINGS

Other objects and advantages of the invention will become apparent from the following description of embodiments thereof with reference to the accompanying drawings wherein.

SUMMARY OF THE INVENTION

The canister of the present invention is provided with a fuel vapors guiding pipe for guiding the fuel vapors from a fuel vapors inlet port into a bed of adsorbent material accomodated within a housing, and a deflector for deflecting the flow of fuel vapors guided by the guiding pipe so as to be dispersed throughout the bed. The deflector is formed of air-permeable material having a flowing resistance slightly larger than that of the bed into a frusto-conical plate.

According to the present invention, one part of the fuel vapors flowing into the bed through the guiding pipe in the fuel vapors adsorbing process flows along the upper surface of the deflector in the direction of the upper portion of the bed and another part of the fuel vapors flows through the deflector in the direction of the lower portion of the bed. Fresh air sucked into the bed in the fuel vapors purging process flows through the bed without being obstructed by the deflector so that the fuel vapors adsorbed by the whole bed are purged.

DETAILED DESCRIPTION OF THE INVENTION

Hereinafter, the present invention will be explained in detail in accordance with the embodiments with reference to the drawings.

Figure 1:
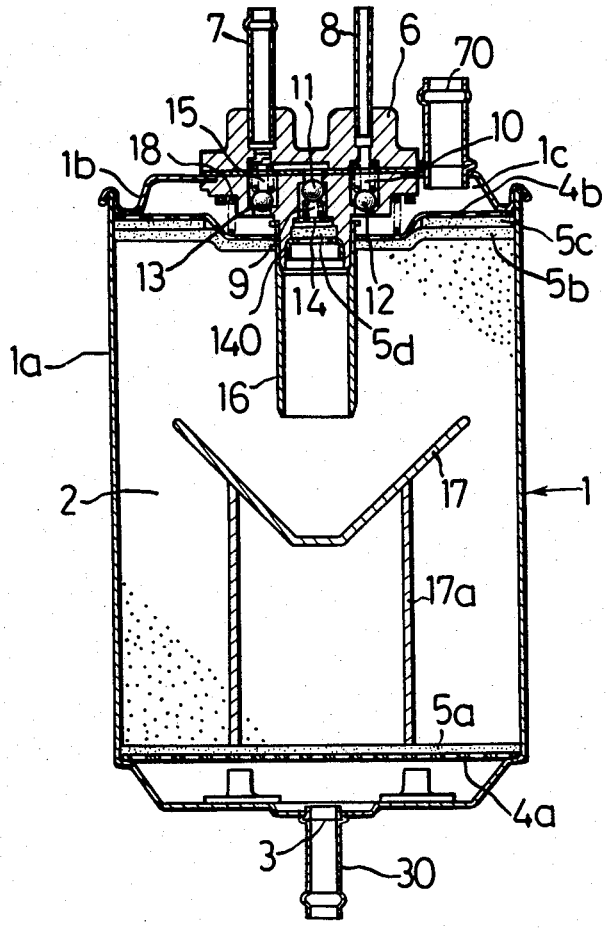
FIG. 1 is a longitudinal sectional view of a first embodiment of the canister according to the present invention.

FIG. 1 illustrates a first embodiment of the canister according to the present invention.

In FIG. 1, a cylindrical housing 1 is composed of a main body 1*a* and a cover member 1*b*.

In the lower end wall of the main body 1*a*, an air suction port 3 is formed and an air suction pipe 30 which is communicated with the atmosphere is attached thereto.

In the bottom portion of the main body 1*a*, a punched metal plate 4*a* is provided like a shelf and a filter 5*a* formed of glass wool, unwoven fabric or the like is mounted on the punched metal plate 4*a*.

Within the main body 1*a*, granular activated carbon is charged to form a bed of adsorbent material 2. On the upper surface of the adsorbent bed 2, filters 5*b*, 5*c* are disposed. And on the filter 5*c*, a punched metal plate 4*b* is mounted. Between the plate 4*b* and the cover member 1*b*, a space 1*c* is formed.

In the central portion of the cover member 1*b*, a valve base body 6 is provided. And to the valve base body 6, a fuel vapors inlet pipe 7 and a purged vapors outlet pipe 8 are attached. The fuel vapors inlet pipe 7 is communicated with a fuel tank (not shown) and the purged vapors outlet pipe 8 is communicated with a carburetor (not shown) of an internal combustion engine on the upper stream side of a throttle valve thereof.

In the valve base body 6, a fuel vapors inlet port 9 communicated with the fuel vapors inlet pipe 7, and a purged vapors outlet port 10 communicated with the purged vapors outlet pipe 8 are formed. And in each of the inlet port 9 and the outlet port 10, a check valve is provided.

The inlet port 9 is positioned in the central portion of the base body 6 and is closed by means of a check ball 11 which is pressed by a spring upwardly. The inlet port 9 is communicated with the interior of the container 1 by way of a through hole formed in a spring supporting plate 14, a filter 5*d* and a through hole formed in a fixing metal 140.

The outlet port 10 is closed by means of a check ball 12 which is pressed by a spring downwardly.

In the valve base body 6, a through hole 15 which communicates with the inlet pipe 7 and the interior of the housing 1, is formed. And the through hole 15 is closed by means of a check ball 13 which is pressed by a spring downwardly.

Furthermore, to the cover member 1*b*, a fuel vapors inlet pipe 70 which is communicated with a float chamber of a carburetor (not shown) is attached.

To the outer periphery of the projecting portion of the valve base body 6 wherein the inlet port 9 is formed, the fuel vapors guiding pipe 16 is attached so as to project towards the lower end wall of the main body 1*a* of the housing 1. The projecting end of the fuel vapors guiding pipe 16 is positioned within the adsorbent bed 2 and the interior of the guiding pipe 16 is charged with adsorbent material.

The adsorbent bed 2 is pressed by the valve base body 6 through a spring 18, the punched metal plate 4*b* and the filters 5*b*, 5*c*.

Within the adsorbent bed 2, a plate-shaped deflector 17 which deflects the flowing direction of the fuel vapors entering the adsorbent bed 2 through the guiding pipe 16, is buried so as to be opposed to the projecting end of the guiding pipe 16.

The deflector 17 is formed of fiber paper of activated carbon having a flowing resistance slightly larger than that of the adsorbent bed 2, and has a frusto-conical shape of which diameter increases upwardly. And the deflector 17 is supported by a plurality of rod-shaped supporting members 17*a*.

When the engine is stopped and the pressure of fuel vapors generated in the fuel tank reaches a predetermined pressure. the check ball 11 opens the fuel vapors inlet port 9 so that the fuel vapors enter the housing 1. At this time, the fuel vapors flow through the guiding pipe 16 into the adsorbent bed.

And the fuel vapors of the float chamber, of which volume is much smaller than that of the fuel vapors from the fuel tank, enter the housing 1 through the inlet pipe 70, and flow into the adsorbent bed 2 from the upper surface thereof.

Figure 2:
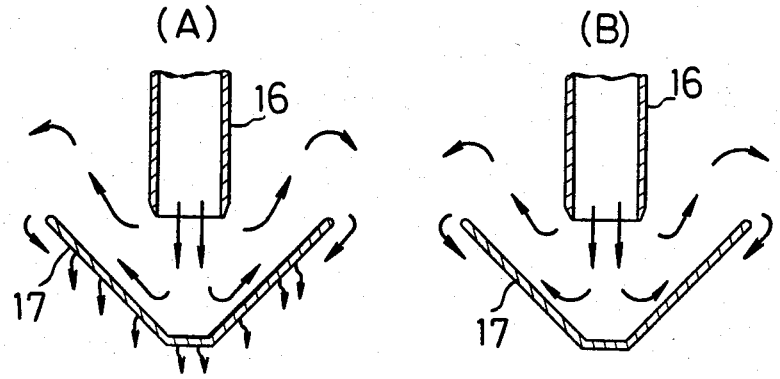
FIGS. 2(A), 2(B) are views illustrating the flowing direction of the fuel vapors in the vicinity of the deflector in the fuel vapors adsorbing process, respectively.

As shown in FIG. 2(A), the fuel vapors flowing into the adsorbent bed 2 reaches the deflector 17. And one part of the fuel vapors passes through the deflector 17 and flows into the lower portion of the adsorbent bed 2. The other part of the fuel vapors flows along the upper surface of the deflector 17 to the open end thereof and changes the flowing direction downwardly.

When the deflector 17 adsorbs the fuel vapors so as to be saturated therewith, exothermic reaction is stopped so that the temperature of the fuel vapors falls. As a result, in the deflector 17, one part of the fuel vapors is liquefied. And as such a liquefying phenomenon proceeds, air-permeability of the deflector 17 is lowered.

As a result, the fuel vapors flow along the deflector 17 without passing therethrough and flow into the lower portion of the adsorbent bed 2 round the open end of the deflector 17 as shown in FIG. 2(B).

In either case, one part or all of the fuel vapors flow along the upper surface of the deflector 17 upwardly so that fuel vapors reach the upper portion of the bed 2 and are adsorbed therein.

And one part of the fuel vapors flowing along the upper surface of the deflector 17, flow round the open end thereof and into the lower portion of the adsorbent bed 2. Therefore, the fuel vapors also reach the outer periphery of the lower portion of the adsorbent bed 2 so that the adsorbing efficiency of the adsorbent bed is greatly improved.

Next, when the engine is operated and the negative pressure of the carburetor reaches a predetermined pressure, the check ball 12 moves upwardly due to this negative pressure to open the outlet port 10.

Then, fresh air is sucked into the housing 1 from the air suction port 3 and flows upwardly within the adsorbent bed 2. As a result, the adsorbed fuel vapors are purged from the adsorbent bed 2 and the mixture composed of the purged fuel vapors and the fresh air is sucked into the carburetor through the outlet port 10 and the outlet pipe 8.

Figure 3:
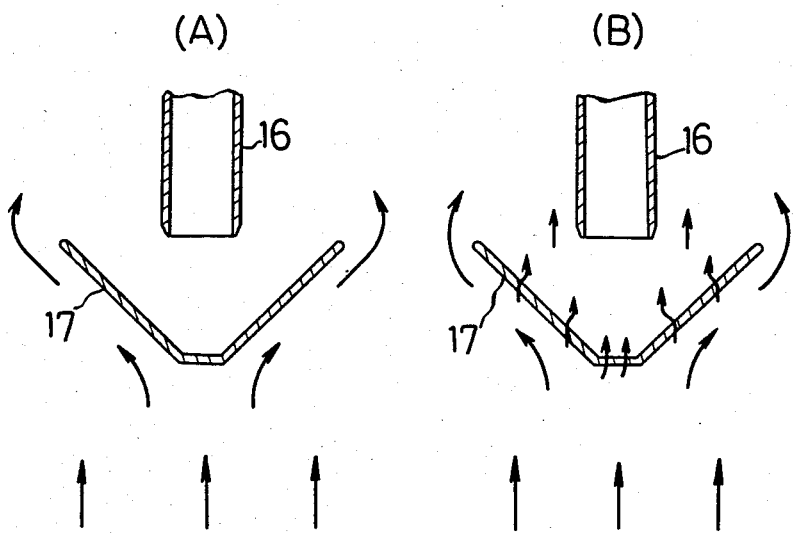
FIGS. 3(A), 3(B) are views illustrating the flowing direction of the fuel vapors in the vicinity of the deflector in the fuel vapors purging process, respectively.

When the air-permeability of the deflector 17 is lowered due to the liquefaction of fuel vapors, the sucked air collides with the deflector 17 and flows along the lower surface of the deflector 17 upwardly as shown in FIG. 3(A) in the first stage of the fuel vapors purging process. Therefore, the fuel vapors adsorbed in the adsorbent bed positioned directly above the deflector 17 are not purged therefrom.

However, as the fuel vapors purging process proceeds, the liquefied fuel vapors are gradually evaporated so that the air-permeability of the deflector 17 is revived. As a result, one part of the air passes through the deflector 17 as shown in FIG. 3(B) to purge the fuel vapors adsorbed in the adsorbent bed directly above the deflector 17.

The through hole 15 is formed in the valve base body 6 opens to supply air into the fuel tank when the inner pressure of the fuel tank is negative.

The present inventors conducted tests on the adsorbing and purging capacity of the canister of the first embodiment (Canister A), the canister provided with the deflector formed of a metallic plate and having the same shape as that of the first embodiment (Canister B) and the canister which is not provided with any deflector (Canister C).

Figure 4:
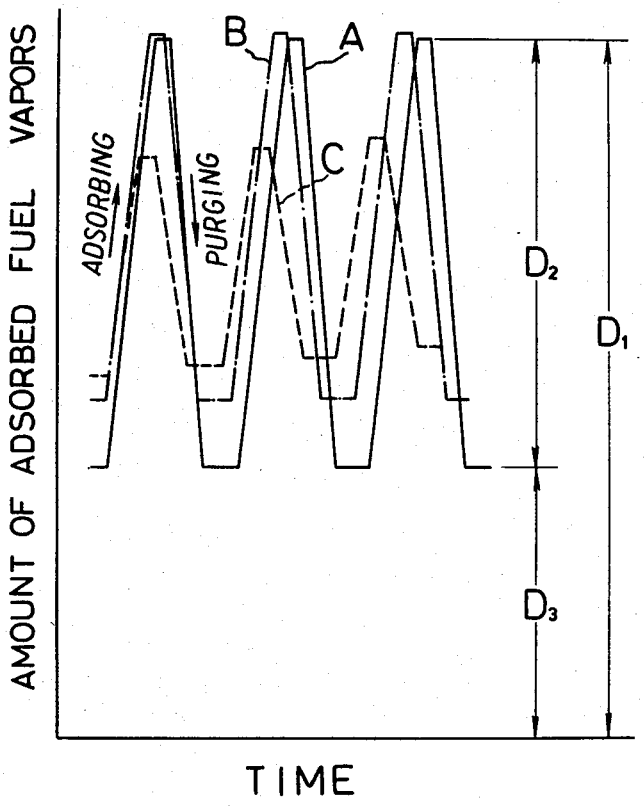
FIG. 4 is a graph showing the relation between the adsorbing capacity and the purging capacity of canisters.

The result of tests is shown in FIG. 4.

In FIG. 4, the reference character $D_1$ designates the total amount of adsorbed fuel vapors, the reference character $D_2$ designates the average amount of adsorbed or purged fuel vapors and the reference character $D_3$ designates the amount of unpurged fuel vapors. And the lines A, B, C show the capacity of Canisters A, B, C, respectively.

As is apparent from FIG. 4, the amount of the adsorbed and purged fuel vapors of Canister C is the smallest and the amount of unpurged fuel vapors of Canister C is the largest as compared with the other Canisters A, B.

This is considered to be caused by the fact that in Canister C, the fuel vapors guided by the guiding pipe 16 in the fuel vapors adsorbing process flow only into the lower portion of the bed while the upper portion of the bed is not used for adsorbing fuel vapors, and that the purged vapors which are purged in the lower portion of the bed in the fuel vapors purging process are adsorbed in the upper portion of the bed again.

With respect to Canister B, the amount of adsorbed fuel vapors is large while the amount of purged fuel vapors is small.

This is considered to be caused by the fact that in Canister B, the fuel vapors adsorbed in the adsorbent bed above the deflector are not purged in the fuel vapors purging process since the sucked fresh air is obstructed by the deflector.

With respect to Canister A, the amount of adsorbed fuel vapors is equal to that of Canister B while the amount of purged fuel vapors is much larger than that of Canisters B, C. Therefore, the canister of the first embodiment of the present invention exhibits excellent adsorbing and purging capacity.

Furthermore, according to Canister A, the amount of unpurged fuel vapors is the smallest as compared with the other Canisters B, C. Since the capacity of canister lowers as the amount of unpurged fuel vapors increases, the canister of the first embodiment of the present invention is superior to the other Canisters B, C.

As described above, according to the first embodiment, by providing the deflector having an air-permeability so as to be opposed to the fuel vapors guiding pipe within the adsorbent bed, one part of the fuel vapors entering the adsorbent bed from the guiding pipe can be directed to the outer peripheral portion of the upper adsorbent bed. As a result, the fuel vapors can be adsorbed in the upper portion of the adsorbent bed.

And since another part of the fuel vapors can flow into the outer peripheral portion of the lower adsorbent bed, the fuel vapors can be spread throughout the lower adsorbent bed.

Therefore, the adsorbing efficiency of the adsorbent bed can be increased.

Furthermore, when the fuel vapors are purged from the adsorbent material, the air to be used for the separation of fuel vapors can flow, passing through the deflector so that the fuel vapors adsorbed by the adsorbent bed directly above the deflector can be easily purged therefrom.

Therefore, the whole adsorbent bed can be revived without any trouble.

Figure 5:
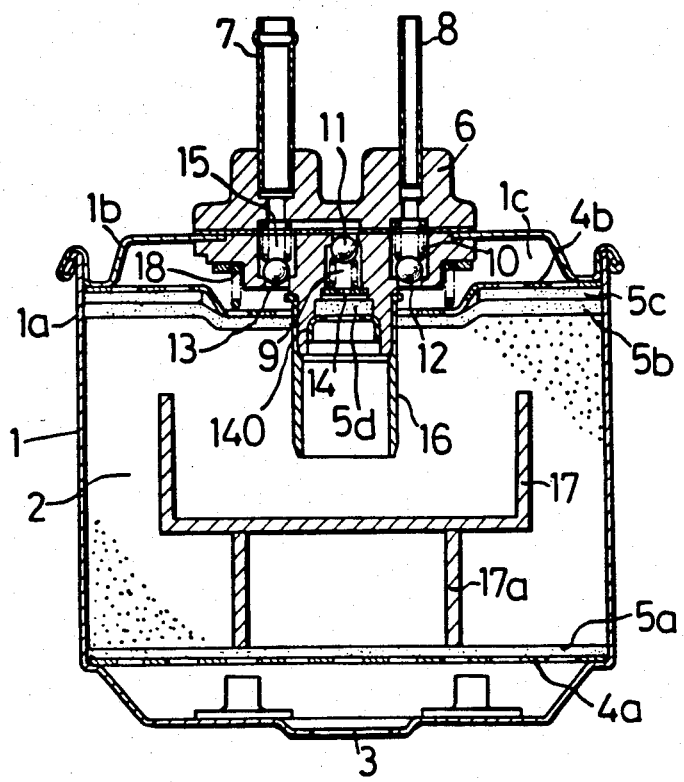
FIG. 5 is a longitudinal sectional view of a second embodiment of the canister according to the present invention.

FIG. 5 illustrates a second embodiment of the canister according to the present invention.

In the second embodiment, the deflector 17 has a bottomed cylindrical shape.

The canister of the second embodiment is not communicated with the float chamber of the carburetor.

Other structure of the second embodiment is substantially equal to that of the first embodiment.

Figure 6:
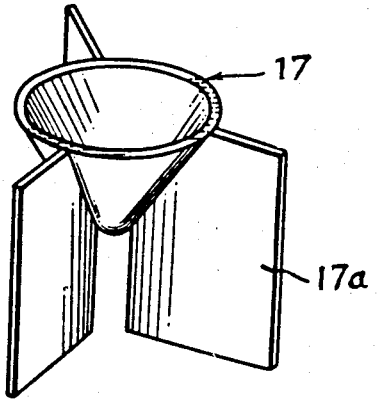
FIG. 6 is a perspective view of a modification of the deflector.

FIG. 6 illustrates a modification of the supporting member of the deflector.

In FIG. 6, the supporting member **17*a* has a plate shape and is joined to the bottom surface of the deflector 17 in the radial direction thereof. And the circumscribed circle of the supporting member 17*a* has a diameter equal to that of the inner wall of the housing 1. By forming the supporting member as illustrated in FIG. 6, the deflector 17 can be easily positioned within the housing 1 and stably supported by the supporting member 17*a***.

The deflector 17 can be formed of other material than activated carbon fiber paper.

The material having an air-permeability, which does not adsorb fuel vapors, such as unwoven fabric, glass wool, or foamed body can be employed.

Having now fully described the invention, it will be apparent to one of ordinary skill in the art that many changes and modifications can be made thereto without departing from the spirit or scope of the invention as set forth herein.

What is claimed is:

1. A canister to be installed in a fuel (supplying) system of a vehicle, comprising:

a housing having opposed end walls;

a bed of fuel vapor adsorbent material which is provided between said opposed end walls within said housing;

a space being formed between one end surface of said bed and one of said opposed end walls;

a fuel vapors inlet port for introducing fuel vapors into said housing from a fuel tank, which is formed in said one end wall of said housing;

an air suction port for introducing air into said housing, which is formed in the other end wall of said housing;

a purged vapors outlet port for introducing a mixture of fuel vapors purged from said adsorbent material, and air sucked from said air suction port, into an intake passage of an internal combustion engine of said vehicle, which is formed in said one end wall of said housing;

a fuel vapors guiding pipe for guiding fuel vapors introduced from said fuel vapors inlet port into the midportion of said bed, which is communicated with said fuel vapors inlet port and projects into the mid-portion of said bed, passing through said space; and a deflecting member for deflecting the flowing direction of fuel vapors introduced into said bed so that fuel vapors are dispersed throughout said bed, which is formed of air-permeable material having a flowing resistance slightly larger than that of said bed, into a plate shape, and is buried within said bed so as to be opposed to a projecting end of said fuel vapors guiding pipe.

2. A canister according to claim 1, wherein:

said adsorbent material is composed of particles of activated carbon.

3. A canister according to claim 1, wherein:

said deflecting member is formed of activated carbon fiber paper, glass wool, unwoven fabric or foamed body.

4. A canister according to claim 3, wherein:

said deflecting member has a frusto-conical shape, of which open end opposes to said projecting end of said fuel vapors guiding pipe and of which bottom is supported by a supporting means.

5. A canister according to claim 3, wherein:

said deflecting member has a bottomed cylindrical shape, of which open end opposes to said projecting end of said fuel vapors guiding pipe and of which bottom is supported by a supporting means.

6. A canister according to claim 4 or 5, wherein: said supporting means is composed of a plurality of plates which are integrally secured to said deflector in radial directions thereof.

7. A canister according to claim 6, wherein:

the circumscribed circle of said supporting member has a diameter equal to that of the inner wall of said housing.

* * * * *